US006431683B1

(12) United States Patent
Ho et al.

(10) Patent No.: US 6,431,683 B1
(45) Date of Patent: Aug. 13, 2002

(54) HYBRID CARRIER FOR WIDE-ARRAY INKJET PRINTHEAD ASSEMBLY

(75) Inventors: May Fong Ho, Escondido; Joseph E. Scheffelin, Poway; Mohammad Akhavain, Escondido; Brian J. Keefe, La Jolla; Janis Horvath, San Diego, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/812,737

(22) Filed: Mar. 20, 2001

(51) Int. Cl.[7] ..... B41J 2/14
(52) U.S. Cl. ..... 347/50; 347/58
(58) Field of Search ..... 347/12, 13, 42, 347/50, 58, 59, 40; 428/480

(56) References Cited

U.S. PATENT DOCUMENTS

| | | | | |
|---|---|---|---|---|
| 4,463,359 A | | 7/1984 | Ayata et al. | 347/56 |
| 5,016,023 A | | 5/1991 | Chan et al. | 347/42 |
| 5,079,189 A | | 1/1992 | Drake et al. | 437/209 |
| 5,098,503 A | | 3/1992 | Drake | 156/299 |
| 5,160,945 A | | 11/1992 | Drake | 347/42 |
| 5,469,199 A | | 11/1995 | Allen et al. | 347/42 |
| 5,696,544 A | | 12/1997 | Komuro | 347/50 |
| 5,719,605 A | | 2/1998 | Anderson et al. | 347/59 |
| 5,742,305 A | | 4/1998 | Hackleman | 347/42 |
| 5,755,024 A | | 5/1998 | Drake et al. | 29/611 |
| 5,939,206 A | * | 8/1999 | Kneezel et al. | 428/480 |
| 5,946,012 A | | 8/1999 | Courian et al. | 347/63 |

* cited by examiner

*Primary Examiner*—Anh T. N. Vo

(57) ABSTRACT

A wide-array inkjet printhead assembly includes a carrier and a plurality of printhead dies each mounted on the carrier. The carrier includes a substructure and a substrate mounted on the substructure. The substrate includes a plurality of layers and has a plurality of conductive paths extending therethrough. As such, each of the printhead dies are mounted on the substrate and electrically coupled to at least one of the conductive paths of the substrate.

32 Claims, 5 Drawing Sheets

HYBRID CARRIER FOR WIDE-ARRAY INKJET PRINTHEAD ASSEMBLY

THE FIELD OF THE INVENTION

The present invention relates generally to inkjet printheads, and more particularly to a wide-array inkjet printhead assembly.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of drops which can be ejected per second is increased, printing speed can be increased with the wide-array inkjet printing system.

Mounting a plurality of printhead dies on a single carrier, however, requires that the single carrier perform several functions including fluid and electrical routing as well as printhead die support. More specifically, the single carrier must accommodate communication of ink between the ink supply and each of the printhead dies, accommodate communication of electrical signals between the electronic controller and each of the printhead dies, and provide a stable support for each of the printhead dies. Unfortunately, effectively combining these functions in one unitary structure is difficult.

Accordingly, a need exists for a carrier which provides support for a plurality of printhead dies while accommodating fluidic and electrical routing to each of the printhead dies.

SUMMARY OF THE INVENTION

One aspect of the present invention provides an inkjet printhead assembly. The inkjet printhead assembly includes a carrier including a substructure and a substrate mounted on the substructure, and a plurality of printhead dies each mounted on the substrate. The substrate includes a plurality of layers and has a plurality of conductive paths extending therethrough. As such, each of the printhead dies are electrically coupled to at least one of the conductive paths of the substrate.

In one embodiment, the substructure and the substrate each have a first side and a second side. As such, the substrate is mounted on the first side of the substructure and the printhead dies are mounted on the first side of the substrate.

In one embodiment, the substrate includes a first interface on the first side thereof. As such, at least one of the conductive paths communicates with the first interface. Thus, each of the printhead dies are electrically coupled to the first interface.

In one embodiment, the substrate includes a second interface. As such, at least one of the conductive paths communicates with the second interface.

In one embodiment, the substructure has at least one ink passage extending therethrough and the substrate has a plurality of ink passages defined therein. As such, at least one of the ink passages of the substrate communicates with the at least one ink passage of the substructure and at least one of the printhead dies.

In one embodiment, the second side of each of the substructure and the substrate is opposite the first side thereof.

In one embodiment, the layers of the substrate include conductive layers and non-conductive layers. In one embodiment, each of the conductive layers form a portion of at least one of the conductive paths. In one embodiment, the conductive layers include at least one power layer, at least one ground layer, and at least one data layer. In one embodiment, the non-conductive layers of the substrate are formed of a ceramic material.

In one embodiment, the substructure includes a plastic material.

In one embodiment, the substructure includes at least one datum adapted to position the inkjet printhead assembly in at least one dimension. In one embodiment, the substructure includes a plurality of datums adapted to position the inkjet printhead assembly in three dimensions.

Another aspect of the present invention provides a method of forming an inkjet printhead assembly. The method includes providing a substructure, mounting a substrate including a plurality of layers and having a plurality of conductive paths extending therethrough on the substructure, and mounting a plurality of printhead dies on the substrate and electrically coupling the printhead dies with at least one of the conductive paths of the substrate.

Another aspect of the present invention provides a carrier adapted to receive a plurality of printhead dies. The carrier includes a substructure having a first side and a second side, and a substrate mounted on the first side of the substructure. As such, the substrate has a first side adapted to receive the printhead dies and a second side. In addition, the substrate includes a plurality of layers and has a plurality of conductive paths extending therethrough.

Another aspect of the present invention provides a method of forming a carrier for a plurality of printhead dies. The method includes providing a substructure having a first side and a second side, and mounting a substrate having a first side adapted to receive the printhead dies and a second side on the first side of the substructure, wherein the substrate includes a plurality of layers and has a plurality of conductive paths extending therethrough.

The present invention provides a carrier for a wide-array inkjet printhead assembly. As such, the carrier provides support for a plurality of printhead dies and accommodates fluidic and electrical routing to each of the printhead dies. In addition, the carrier facilitates positioning of the inkjet printhead assembly within an inkjet printing system.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
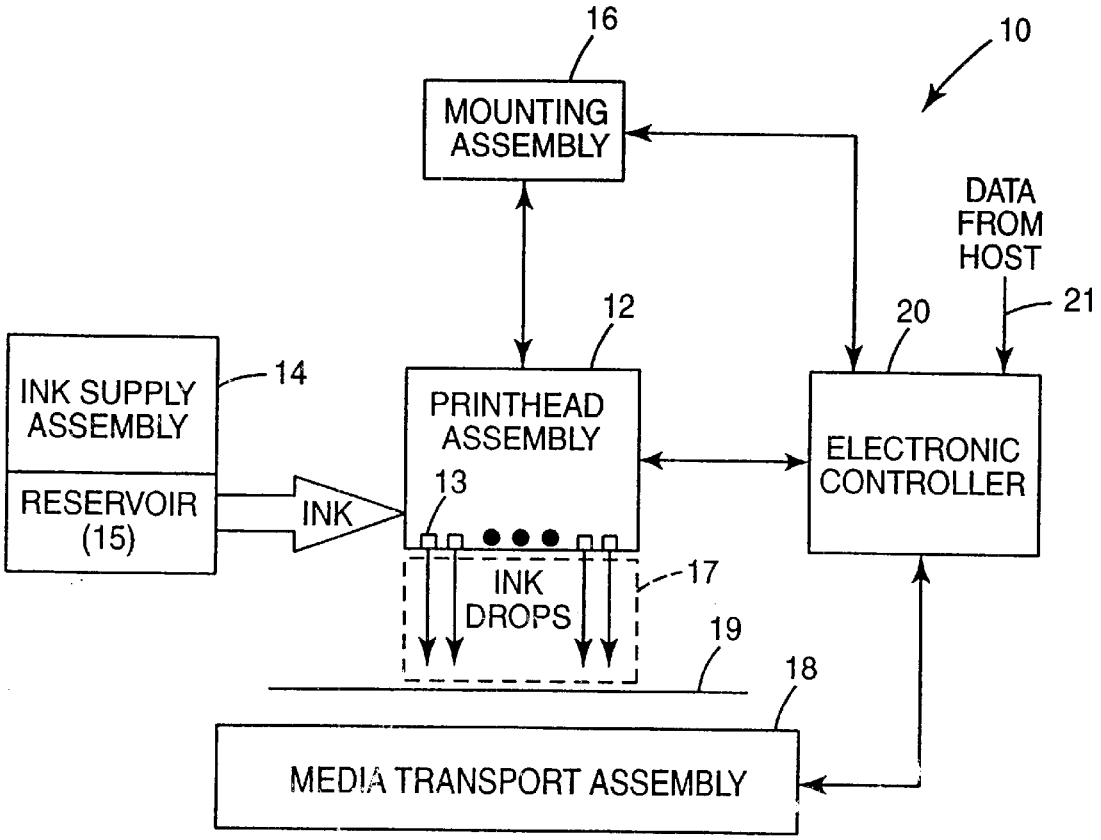
FIG. 1 is a block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
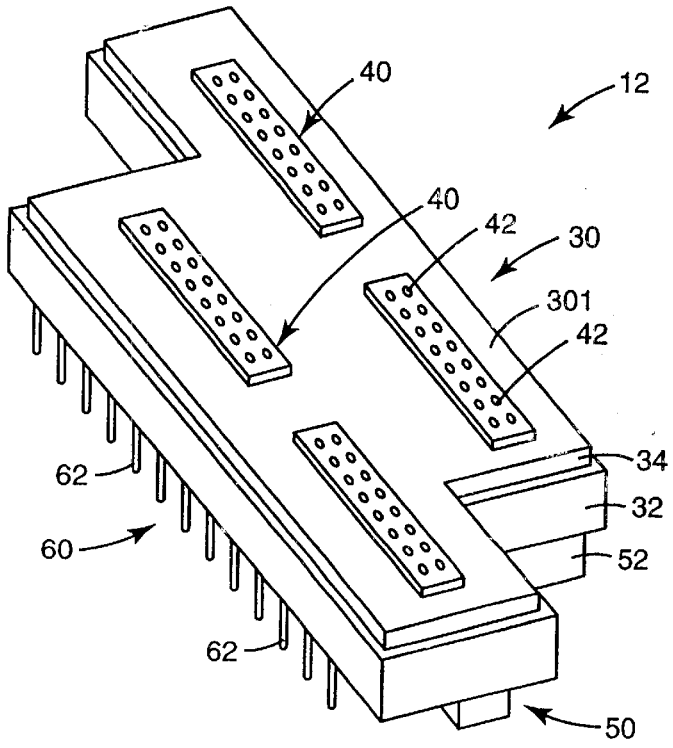
FIG. 2 is a top perspective view of an inkjet printhead assembly including a plurality of printhead dies according to the present invention.
Figure 3:
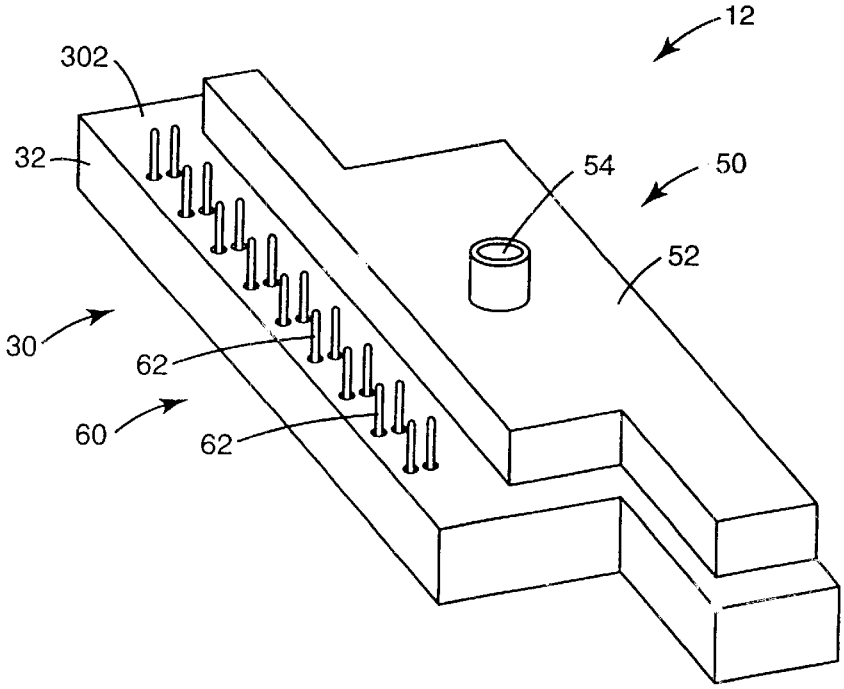
FIG. 3 is a bottom perspective view of the inkjet printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has a first side 301 and a second side 302 which is opposite of and oriented substantially parallel with first side 301. Carrier 30 serves to carry or provide mechanical support for printhead dies 40 and provide fluidic communication between printhead dies 40 and ink supply assembly 14 via ink delivery system 50. In addition, carrier 30 provides electrical communication between printhead dies 40 and electronic controller 20 via electronic interface system 60.

Printhead dies 40 are mounted on first side 301 of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead assemblies 12 are mounted in an end-to-end manner. Carrier 30, therefore, has a staggered or stair-step profile. Thus, at least one printhead die 40 of one inkjet printhead assembly 12 overlaps at least one printhead die 40 of an adjacent inkjet printhead assembly 12. While four printhead dies 40 are illustrated as being mounted on carrier 30, the number of printhead dies 40 mounted on carrier 30 may vary.

Ink delivery system 50 fluidically couples ink supply assembly 14 with printhead dies 40. In one embodiment, ink delivery system 50 includes a manifold 52 and a port 54. Manifold 52 is mounted on second side 302 of carrier 30 and distributes ink through carrier 30 to each printhead die 40. Port 54 communicates with manifold 52 and provides an inlet for ink supplied by ink supply assembly 14. In one embodiment, manifold 52 is formed of plastic and is chemically compatible with liquid ink so as to accommodate fluid delivery.

Electronic interface system 60 electrically couples electronic controller 20 with printhead dies 40. In one embodiment, electronic interface system 60 includes a plurality of electrical contacts 62 which form input/output (I/O) contacts for electronic interface system 60. As such, electrical contacts 62 provide points for communicating electrical signals between electronic controller 20 and inkjet printhead assembly 12. Examples of electrical contacts 62 include I/O pins which engage corresponding I/O receptacles electrically coupled to electronic controller 20 and I/O contact pads or fingers which mechanically or inductively contact corresponding electrical nodes electrically coupled to electronic controller 20.

In one embodiment, electrical contacts 62 are provided on a side of carrier 30. Although electrical contacts 62 are illustrated as being provided on second side 302 of carrier 30, it is within the scope of the present invention for electrical contacts 62 to be provided on other sides of carrier 30.

Figure 4:
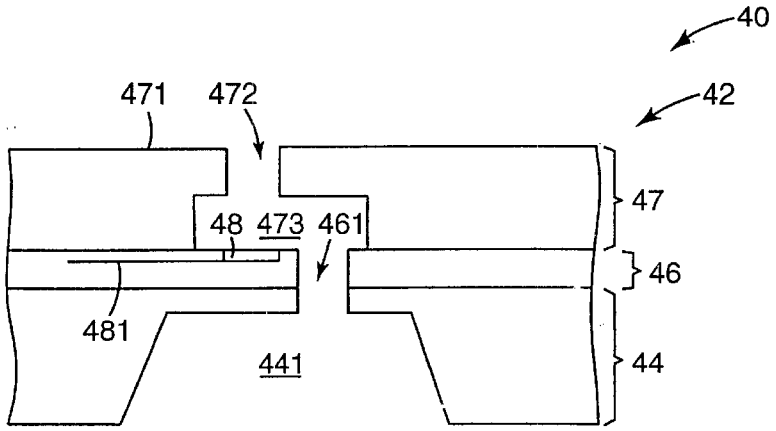
FIG. 4 is a schematic cross-sectional view illustrating portions of a printhead die according to the present invention.

As illustrated in FIGS. 2 and 4, each printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Figure 5:
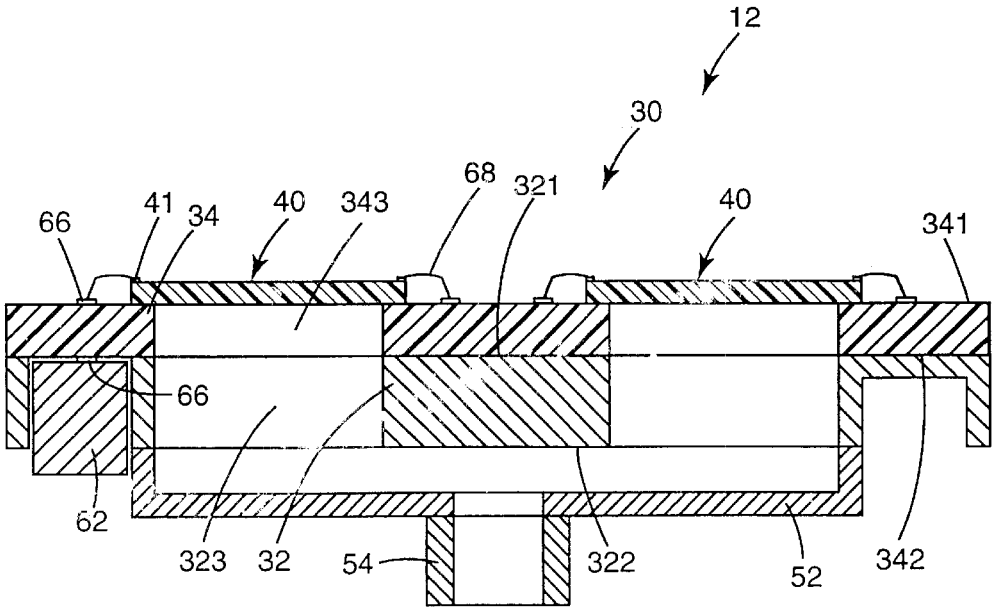
FIG. 5 is a schematic cross-sectional view illustrating one embodiment of an inkjet printhead assembly according to the present invention.

Referring to FIGS. 2 and 5, carrier 30 includes a substructure 32 and a multi-layer substrate 34. Substructure 32 and multi-layer substrate 34 both provide and/or accommodate mechanical, electrical, and fluidic functions of inkjet printhead assembly 12. More specifically, substructure 32 provides mechanical support for multi-layer substrate 34, accommodates fluidic communication between ink supply assembly 14 and printhead dies 40 via ink delivery system 50, and accommodates electrical connection between printhead dies 40 and electronic controller 20 via electronic interface system 60. Multi-layer substrate 34, however, provides mechanical support for printhead dies 40, accommodates fluidic communication between ink supply assembly 14 and printhead dies 40 via ink delivery system 50, and provides electrical connection between and among printhead dies 40 and electronic controller 20 via electronic interface system 60. In addition, substructure 32 facilitates positioning of inkjet printhead assembly 12 in mounting assembly 16, as described below.

Substructure 32 has a first side 321 and a second side 322 which is opposite first side 321. In one embodiment, multi-layer substrate 34 is disposed on first side 321 and ink manifold 52 is disposed on second side 322. As such, multi-layer substrate 34 and ink manifold 52 are both secured to substructure 32. While substructure 32 and ink manifold 52 are illustrated as being formed separately, it is within the scope of the present invention for substructure 32 and ink manifold 52 to be formed as one unitary structure.

In one embodiment, substructure 32 is formed of plastic. Substructure 32 is formed, for example, of a high performance plastic such as fiber reinforced noryl. It is, however, within the scope of the present invention for substructure 32 to be formed of silicon, stainless steel, or other suitable material or combination of materials. Preferably, substructure 32 is chemically compatible with liquid ink so as to accommodate fluidic routing.

Multi-layer substrate 34 has a first side 341 and a second side 342 which is opposite first side 341. In one embodiment, printhead dies 40 are disposed on first side 341 and substructure 32 is disposed on second side 342. Second side 342 of multi-layer substrate 34, therefore, contacts first side 321 of substructure 32 when multi-layer substrate 34 is mounted on substructure 32.

For transferring ink between ink supply assembly 14 and printhead dies 40, substructure 32 and multi-layer substrate 34 each have at least one ink passage 323 and 343, respectively, formed therein. Ink passage 323 extends through substructure 32 and provides a through-channel or through-opening for delivery of ink from manifold 52. Ink passage 343 extends through multi-layer substrate 34 and provides a through-channel or through-opening for delivery of ink to printhead dies 40 from manifold 52 via ink passage 323 of substructure 32.

In one embodiment, one end of ink passage 323 communicates with manifold 52 of ink delivery system 50 and another end of ink passage 323 communicates with ink passage 343. In addition, one end of ink passage 343 communicates with ink passage 323 and another end of ink passage 343 communicates with printhead dies 40 and, more specifically, ink feed slot 441 of substrate 44 (FIG. 4). As such, ink passages 323 and 343 form a portion of ink delivery system 50. Although only one ink passage 343 is shown for a given printhead die 40, there may be additional ink passages to the same printhead die, for example, to provide ink of respective differing colors.

Figure 6:
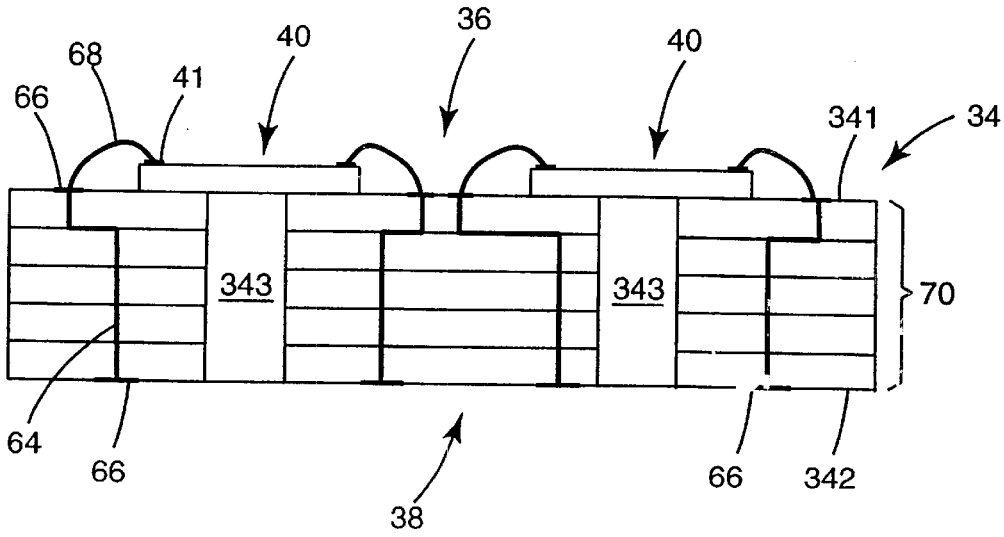
FIG. 6 is a schematic cross-sectional view of a multi-layer substrate of the inkjet printhead assembly of FIG. 5.

For transferring electrical signals between electronic controller 20 and printhead dies 40, electronic interface system 60 includes a plurality of conductive paths 64 extending through multi-layer substrate 34, as illustrated in FIG. 6. More specifically, multi-layer substrate 34 includes conductive paths 64 which pass through and terminate at exposed surfaces of multi-layer substrate 34. In one embodiment, conductive paths 64 include electrical contact pads 66 at terminal ends thereof which form, for example, I/O bond pads on multi-layer substrate 34. Conductive paths 64, therefore, terminate at and provide electrical coupling between electrical contact pads 66.

Electrical contact pads 66 define a first interface 36 and a second interface 38 of multi-layer substrate 34. As such, first interface 36 and second interface 38 provide points for electrical connection to multi-layer substrate 34 and, more specifically, conductive paths 64. Electrical connection is established, for example, via electrical connectors or contacts 62, such as I/O pins or spring fingers, wire bonds, electrical nodes, and/or other suitable electrical connectors.

In one embodiment, printhead dies 40 include electrical contacts 41 which form I/O bond pads. As such, electronic interface system 60 includes electrical connectors, for example, wire bond leads 68, which electrically couple electrical contact pads 66 of first interface 36 with electrical contacts 41 of printhead dies 40.

Conductive paths 64 transfer electrical signals between electronic controller 20 and printhead dies 40. More specifically, conductive paths 64 define transfer paths for power, ground, and data among and/or between printhead dies 40 and electrical controller 20. In one embodiment, data includes print data and non-print data. Print data includes, for example, nozzle data containing pixel information such as bitmap print data. Non-print data includes, for example, command/status (CS) data, clock data, and/or synchronization data. Status data of CS data includes, for example, printhead temperature or position, print resolution, and/or error notification.

In one embodiment, as illustrated in FIGS. 5 and 6, conductive paths 64 terminate at first side 341 and second side 342 of multi-layer substrate 34. Thus, electrical contact pads 66 are provided on first side 341 and second side 342 of multi-layer substrate 34. As such, conductive paths 64 provide electrical coupling between electrical contact pads 66 on second side 342 of multi-layer substrate 34 and electrical contact pads 66 on first side 341 of multi-layer substrate 34. First interface 36 and second interface 38, therefore, are provided on first side 341 and second side 342, respectively. Accordingly, electrical contacts 62 are electrically coupled at one end to electrical contact pads 66 provided on second side 342 and wire bond leads 68 are electrically coupled at one end to electrical contact pads 66 provided on first side 341 and at another end to electrical contacts 41 of printhead dies 40.

By providing second interface 38 on second side 342 of multi-layer substrate 34, the number of electrical connections on first side 341 of multi-layer substrate 34 is minimized. In one embodiment, the only electrical connections on first side 341 of multi-layer substrate 34 are those made between first interface 36 and printhead dies 40. As such, electrical connections between second interface 38 and electrical contacts 62 are provided away from print zone 17 and, more specifically, away from ink mist or spray which may be generated as ink drops are ejected from nozzles 13 during printing. Thus, electrical connections between electrical contacts 62 and electrical contact pads 66 are protected from possible ink ingression.

While conductive paths 64 are illustrated as terminating at first side 341 and second side 342 of multi-layer substrate 34, it is, however, within the scope of the present invention for conductive paths 64 to terminate at other sides of multi-layer substrate 34. In addition, one or more conductive paths 64 may branch from and/or lead to one or more other conductive paths 64. Furthermore, one or more conductive paths 64 may begin and/or end within multi-layer substrate 34.

Figure 7:
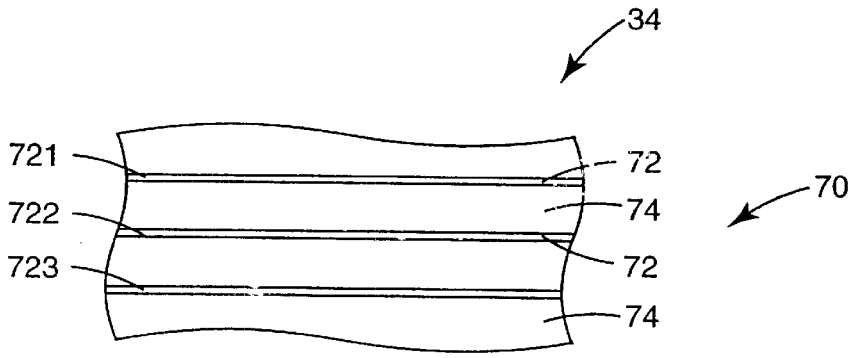
FIG. 7 is a schematic cross-sectional view of a portion of the multi-layer substrate of FIG. 6.

As illustrated in FIGS. 6 and 7, multi-layer substrate 34 is formed of multiple layers 70. In one embodiment, layers 70 include a plurality of conductive layers 72 and a plurality of non-conductive or insulative layers 74. conductive layers 72 are formed, for example, by patterned traces of conductive material on insulative layers 74. As such, at least one insulative layer 74 is interposed between two conductive layers 72. Conductive layers 72 include, for example, a power layer 721, a data layer 722, and a ground layer 723. Thus, power layer 721 conducts power for printhead dies 40, data layer 722 carries data for printhead dies 40, and ground layer 723 provides grounding for printhead dies 40.

Power layer 721, data layer 722, and ground layer 723 individually form portions of conductive paths 64 through multi-layer substrate 34. Thus, power layer 721, data layer 722 and ground layer 723 are each electrically coupled to first interface 36 and second interface 38 of multi-layer substrate 34 by, for example, conductive material which passes through insulative layers 74 and selectively joins conductive layers 72. As such, power, data, and ground are communicated between first interface 36 and second interface 38 of multi-layer substrate 34.

The number of conductive layers 72 and insulative layers 74 of multi-layer substrate 34 can vary depending on the number of printhead dies 40 to be mounted on carrier 30 as well as the power and data rate requirements of printhead dies 40. In addition, conductive layers 72 and insulative layers 74 may be formed and/or arranged as described, for example, in U.S. patent application Ser. No. 09/648,565, entitled"Wide-Array Inkjet Printhead Assembly with Internal Electrical Routing System" assigned to the assignee of the present invention and incorporated herein by reference.

It is to be understood that FIGS. 5–7 are simplified schematic illustrations of carrier 30, including substructure 32 and multi-layer substrate 34. The illustrative routing of ink passages 323 and 343 through substructure 32 and multi-layer substrate 34, respectively, and conductive paths 64 through multilayer substrate 34, for example, has been simplified for clarity of the invention. Although various features of carrier 30, such as ink passages 323 and 343 and conductive paths 64, are schematically illustrated as being straight, it is understood that design constraints could make the actual geometry more complicated for a commercial embodiment of inkjet printhead assembly 12. Ink passages 323 and 343, for example, may have more complicated geometries to allow multiple colorants of ink to be channeled through carrier 30. In addition, conductive paths 64 may have more complicated routing geometries through multi-layer substrate 34 to avoid contact with ink passages 343 and to allow for electrical connector geometries other than the illustrated I/O pins. It is understood that such alternatives are within the scope of the present invention.

Figure 8:
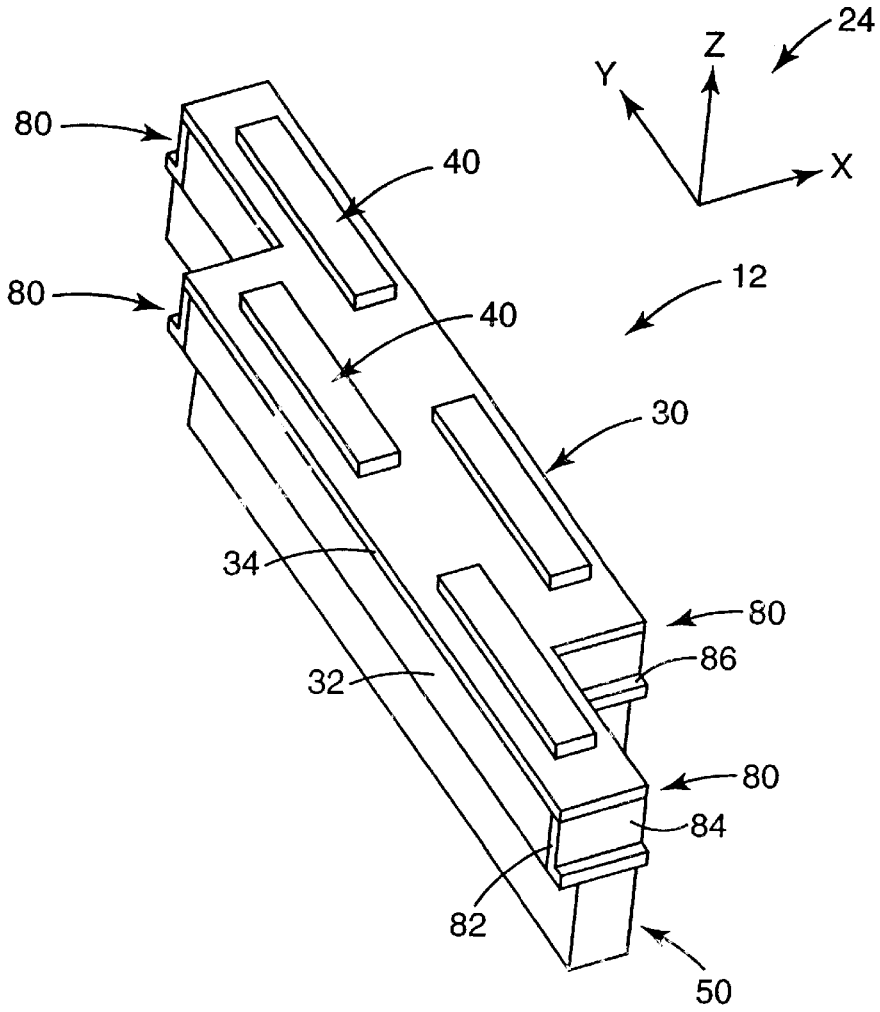
FIG. 8 is a top perspective view of one embodiment of an inkjet printhead assembly including a plurality of datums according to the present invention.

Referring to FIG. 8, inkjet printhead assembly 12 has an x-axis in an x dimension, a y-axis in a y dimension, and a z-axis in a z dimension, as indicated by arrows 24. In one embodiment, the x-axis represents a scanning axis of inkjet printhead assembly 12 and the y-axis represents a paper axis of inkjet printhead assembly 12. More specifically, the x-axis extends in a direction coinciding with relative side-to-side movement of inkjet printhead assembly 12 during printing and the y-axis extends in a direction coinciding with relative advancement between print medium 19 and inkjet printhead assembly 12 during printing.

The z-axis of inkjet printhead assembly 12 extends in a direction substantially perpendicular to front face 471 of printhead dies 40. More specifically, the z-axis extends in a direction coinciding with ink drop ejection from printhead dies 40 during printing. Thus, spacing between inkjet printhead assembly 12 and print medium 19, referred to as pen-to-paper spacing, is measured along the z-axis. Pen-to-paper spacing, therefore, is controlled by relative positioning of inkjet printhead assembly 12 along the z-axis.

As described above, mounting assembly 16 positions inkjet printhead assembly 12 relative to media transport assembly 18. As such, inkjet printhead assembly 12 is mounted within and positioned relative to mounting assembly 16. Mounting assembly 16, therefore, positions inkjet printhead assembly 12 with reference to the x-axis, the y-axis, and the z-axis thereof.

In one embodiment, to position inkjet printhead assembly 12 in x, y, and z dimensions, inkjet printhead assembly 12 includes a plurality of datums 80. As such, datums 80 establish reference points for positioning of inkjet printhead assembly 12. Thus, when inkjet printhead assembly 12 is mounted within mounting assembly 16, datums 80 contact corresponding and/or complementary portions of mounting assembly 16. Mounting of inkjet printhead assembly 12 in mounting assembly 16 is described, for example, in U.S. patent application Ser. No. 09/648,121, entitled"Carrier Positioning for Wide-Array Inkjet Printhead Assembly" assigned to the assignee of the present invention and incorporated herein by reference. Datums 80 may also be used to position inkjet printhead assembly 12 during manufacture and/or assembly of inkjet printhead assembly 12.

Datums 80 include an x-datum 82, a y-datum 84, and a z-datum 86. As such, x-datum 82, y-datum 84, and z-datum 86 contact mounting assembly 16 when inkjet printhead assembly 12 is mounted within mounting assembly 16. Preferably, x-datum 82, y-datum 84, and z-datum 86 are formed on substructure 32 of carrier 30. Thus, x-datum 82, y-datum 84, and z-datum 86 position carrier 30 and, therefore, inkjet printhead assembly 12 relative to mounting assembly 16 along the x axis, the y axis, and the z axis, respectively, of inkjet printhead assembly 12.

By separating support and positioning functions of substructure 32 from electrical functions of multi-layer substrate 34, more design freedom for both substructure 32 and multi-layer substrate 34 is available. Thus, more freedom in material choice and design of substructure 32 as well as electrical routing in multi-layer substrate 34 is available.

For example, by forming datums 80 on substructure 32, forces generated by installing and/or removing inkjet printhead assembly 12 into and from mounting assembly 16 are applied to substructure 32. As such, stress at the joint between substructure 32 and multi-layer substrate 34 is minimized. The joint between substructure 32 and multi-layer substrate 34, therefore, may be simplified. In addition, since printhead dies 40 are mounted on multi-layer substrate 34 and multi-layer substrate 34 is mounted on substructure 32, installing and/or removing inkjet printhead assembly 12 into and/or from mounting assembly 16 does not affect alignment of multi-layer substrate 34 and, therefore, printhead dies 40 relative to substructure 32. Thus, relative positioning between multi-layer substrate 34, including printhead dies 40, and substructure 32 is maintained.

In addition, by forming substructure 32 and ink manifold 52 of the same material, greater flexibility in the design of the joint between substructure 32 and ink manifold 52 is possible. For example, by forming both substructure 32 and ink manifold 52 of plastic, portions of substructure 32 and ink manifold 52 may be molded or formed so as to mate with corresponding portions of each other.

Furthermore, by forming substrate 34 of multiple layers, power, ground, and data connections between electronic controller 20 and printhead dies 40 are facilitated. Thus, by routing power, ground, and data lines through multi-layer substrate 34, electrical interfaces which are prone to corrosion and/or ink ingression are eliminated.

By forming substructure 32 of plastic and multi-layer substrate 34 of ceramic, a hybrid design for carrier 30 is formed which combines favorable qualities or characteristics of a plastic substructure with those a multi-layer ceramic substrate. For example, by forming substructure 32 of plastic, substructure 32 can be molded as an intricate three-dimensional object. As such, complex, three-dimensional ink passages 323 and datums 80 can be more easily formed with substructure 32 as compared with multi-layer substrate 34. By forming substructure 32 of plastic, however, substructure 32 does not provide a surface for mounting of printhead dies 40 which is as dimensionally stable as multi-layer substrate 34. Furthermore, by forming substructure 32 of plastic, complicated electrical routing through substructure 32 is not easily achieved.

In addition, by forming multi-layer substrate 34 of ceramic, multi-layer substrate 34 provides a surface for mounting of printhead dies 40 which is more dimensionally stable and substantially more planar than that of substructure 32. Furthermore, by forming multi-layer substrate 34 of ceramic, more intricate electrical routing for printhead dies 40 can be achieved with multi-layer substrate 34 as compared with substructure 32. Complicated traces of conductive material, for example, can be easily formed with layers 70 of multi-layer substrate 34. Forming multi-layer substrate 34 of ceramic, however, offers less design flexibility for fluid routing and datum positioning since individual layers of multi-layer substrate 34 are essentially limited to two-dimensional designs.

Thus, the hybrid design of carrier 30 provides a combined functionality for carrier 30 which is superior to that which is attainable from substructure 32 or multi-layer substrate 34 individually. As such, the hybrid design of carrier 30 results in a carrier for printhead dies 40 which provides complex fluid routing and datum positioning as well as complex electrical routing and stable printhead die support.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead assembly, comprising:

a carrier including a substructure and a substrate mounted on the substructure, the substrate including a plurality of layers and having a plurality of conductive paths extending therethrough, wherein the substructure and the substrate each have a first side and a second side, the substrate being mounted on the first side of the substructure and the printhead dies being mounted on the first side of the substrate, wherein the substrate includes a first interface on the first side thereof and a second interface, wherein at least one of the conductive paths communicates with the first interface and the second interface; and a plurality of printhead dies each mounted on the substrate and electrically coupled to the first interface and at least one of the conductive paths of the substrate.

2. The inkjet printhead assembly of claim 1, wherein the substructure has at least one ink passage extending therethrough and the substrate has a plurality of ink passages defined therein, wherein at least one of the ink passages of the substrate communicates with the at least one ink passage of the substructure and at least one of the printhead dies.

3. The inkjet printhead assembly of claim 1, wherein the second side of each of the substructure and the substrate is opposite the first side thereof.

4. The inkjet printhead assembly of claim 1, wherein the layers of the substrate include conductive layers and non-conductive layers.

5. The inkjet printhead assembly of claim 4, wherein each of the conductive layers form a portion of at least one of the conductive paths.

6. The inkjet printhead assembly of claim 4, wherein the conductive layers include at least one power layer, at least one ground layer, and at least one data layer.

7. The inkjet printhead assembly of claim 4, wherein the non-conductive layers of the substrate are formed of a ceramic material.

8. The inkjet printhead assembly of claim 1, wherein the substructure includes a plastic material.

9. The inkjet printhead assembly of claim 1, wherein the substructure includes at least one datum adapted to position the inkjet printhead assembly in at least one dimension.

10. The inkjet printhead assembly of claim 1, wherein the substructure includes a plurality of datums adapted to position the inkjet printhead assembly in three dimensions.

11. A method of forming an inkjet printhead assembly, the method comprising:

providing a substructure having a first side and a second side;

mounting a substrate having a first side and a second side on the first side of the substructure, the substrate including a plurality of layers and having a plurality of conductive paths extending therethrough, wherein the substrate includes a first interface on the first side thereof and a second interface, wherein at least one of the conductive paths communicates with the first interface and the second interface; and mounting a plurality of printhead dies on the first side of the substrate and electrically coupling the printhead dies with the first interface and at least one of the conductive paths of the substrate.

12. The method of claim 11, wherein the substructure has at least one ink passage extending therethrough and the substrate has a plurality of ink passages defined therein, wherein mounting the substrate includes communicating at least one of the ink passages of the substrate with the at least one ink passage of the substructure, and wherein mounting the printhead dies includes communicating at least one of the printhead dies with the at least one of the ink passages of the substrate.

13. The method of claim 11, wherein the layers of the substrate include conductive layers and non-conductive layers, wherein each of the conductive layers form a portion of at least one of the conductive paths.

14. The method of claim 13, wherein the non-conductive layers of the substrate are formed of a ceramic material.

15. The method of claim 11, wherein the substructure includes a plastic material.

16. The method of claim 11, wherein the substructure includes at least one datum adapted to position the inkjet printhead assembly in at least one dimension.

17. A carrier adapted to receive a plurality of printhead dies, the carrier comprising:

a substructure having a first side and a second side; and a substrate mounted on the first side of the substructure, the substrate having a first side adapted to receive the printhead dies and a second side, wherein the substrate includes a first interface and a second interface, the first interface being disposed on the first side of the substrate and adapted for electrical communication with the printhead dies, and wherein the substrate includes a plurality of layers and has a plurality of conductive paths extending therethrough, wherein at least one of the conductive paths communicates with the first interface and the second interface.

18. The carrier of claim 17, wherein the substructure has at least one ink passage extending therethrough and the substrate has a plurality of ink passages defined therein, wherein at least one of the ink passages of the substrate communicates with the at least one ink passage of the substructure and at least one of the printhead dies.

19. The carrier of claim 17, wherein the second side of each of the substructure and the substrate is opposite the first side thereof.

20. The carrier of claim 17, wherein the layers of the substrate include conductive layers and non-conductive layers.

21. The carrier of claim 20, wherein each of the conductive layers form a portion of at least one of the conductive paths.

22. The carrier of claim 20, wherein the conductive layers include at least one power layer, at least one ground layer, and at least one data layer.

23. The carrier of claim 20, wherein the non-conductive layers of the substrate are formed of a ceramic material.

24. The carrier of claim 17, wherein the substructure includes a plastic material.

25. The carrier of claim 17, wherein the substructure includes at least one datum adapted to position the carrier in at least one dimension.

26. The carrier of claim 17, wherein the substructure includes a plurality of datums adapted to position the carrier in three dimensions.

27. A method of forming a carrier for a plurality of printhead dies, the method comprising:

providing a substructure having a first side and a second side; and mounting a substrate having a first side adapted to receive the printhead dies and a second side on the first side of the substructure, wherein the substrate includes a first interface and a second interface, the first interface being disposed on the first side of the substrate and adapted for electrical communication with the printhead dies, and wherein the substrate includes a plurality of layers and has a plurality of conductive paths extending therethrough, wherein at least one of the conductive paths communicates with the first interface and the second interface.

28. The method of claim 27, wherein the substructure has at least one ink passage extending therethrough and the substrate has a plurality of ink passages defined therein, wherein mounting the substrate includes communicating at least one of the ink passages of the substrate with the at least one ink passage of the substructure.

29. The method of claim 27, wherein the layers of the substrate include conductive layers and non-conductive layers, wherein each of the conductive layers form a portion of at least one of the conductive paths.

30. The method of claim 29, wherein the non-conductive layers of the substrate are formed of a ceramic material.

31. The method of claim 27, wherein the substructure includes a plastic material.

32. The method of claim 27, wherein the substructure includes at least one datum adapted to position the carrier in at least one dimension.

* * * * *